US007724111B2

(12) United States Patent
Paineau et al.

(10) Patent No.: US 7,724,111 B2
(45) Date of Patent: May 25, 2010

(54) MICROSYSTEM WITH ELECTROMAGNETIC CONTROL

(75) Inventors: Sylvain Paineau, Voiron (FR); Caroline Coutier, Grenoble (FR); Amalia Garnier, Grenoble (FR); Benoît Grappe, Saint Egreve (FR); Laurent Chiesi, Reaumont (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 198 days.

(21) Appl. No.: 11/813,591

(22) PCT Filed: Jan. 6, 2006

(86) PCT No.: PCT/EP2006/050074

§ 371 (c)(1),
(2), (4) Date: Oct. 10, 2007

(87) PCT Pub. No.: WO2006/072627

PCT Pub. Date: Jul. 13, 2006

(65) Prior Publication Data

US 2008/0106360 A1 May 8, 2008

(30) Foreign Application Priority Data

Jan. 10, 2005 (FR) ..... 05 50085

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,070,317 | A | 12/1991 | Bhagat | |
| 5,644,177 | A * | 7/1997 | Guckel et al. | 310/40 MM |
| 6,016,092 | A * | 1/2000 | Qiu et al. | 333/262 |
| 6,310,526 | B1 * | 10/2001 | Yip et al. | 333/262 |
| 6,320,145 | B1 | 11/2001 | Tai et al. | |
| 6,410,360 | B1 | 6/2002 | Steenberge | |
| 6,593,834 | B2 * | 7/2003 | Qiu et al. | 333/262 |
| 6,750,745 | B1 | 6/2004 | Wei et al. | |
| 6,894,592 | B2 * | 5/2005 | Shen et al. | 335/78 |
| 2002/0050880 | A1 | 5/2002 | Ruan et al. | |
| 2002/0140533 | A1 | 10/2002 | Miyazaki et al. | |
| 2004/0183633 | A1 | 9/2004 | Shen et al. | |

FOREIGN PATENT DOCUMENTS

WO 02 095784 11/2002

OTHER PUBLICATIONS

U.S. Appl. No. 11/854,588, filed Sep. 13, 2007, Chiesi, et al.

* cited by examiner

*Primary Examiner*—Lincoln Donovan
*Assistant Examiner*—Bernard Rojas
(74) *Attorney, Agent, or Firm*—Oblon, Spivak, McClelland, Maier & Neustadt, L.L.P.

(57) ABSTRACT

A microsystem, including a magnetic microactuator, with a mobile element supported by a substrate and controlled by magnetic effect between a first position and a second position for switching at least one electric circuit. A permanent magnet or a solenoid subjects the mobile element to a first uniform magnetic field to hold the mobile element in the first position. An energizing coil external to the substrate, on energizing, subjects the mobile element to a second magnetic field to move the mobile element from the first position to the second position, the energizing coil being of solenoid type and surrounding the substrate supporting the mobile element.

12 Claims, 3 Drawing Sheets

MICROSYSTEM WITH ELECTROMAGNETIC CONTROL

The present invention relates to a microsystem comprising at least one magnetic microactuator actuated by means of an external excitation coil. Such a microsystem may be used as an electrical interrupter, in particular for the switch contactor or relay type. This type of microsystem is particularly suitable for being produced in MEMs technology.

Document U.S. Pat. No. 6,320,145 describes a magnetostatic relay. This relay operates by means of a magnetizable and monostable beam. Under the action of a magnetic field, this beam flexes, so as to tend to be aligned in the direction of this magnetic field and closes an electrical circuit. Since the beam is fabricated in a resilient material, it returns to its initial position simply by a mechanical effect when there is no magnetic field/beam interaction. The restoring force on the beam restoring it to its initial position, is therefore of purely mechanical origin and is imposed merely by the nature of the material for fabricating the beam and by the geometry of the elements involved.

Patents U.S. Pat. No. 6,469,602 and U.S. Pat. No. 6,750,745 describe magnetic microrelays using the movement of a bistable magnetizable beam between two positions to open or close an electrical circuit. The movement of the beam is actuated by means of an electromagnet The electrical circuit is open when the beam is in a first position, and the electrical circuit is closed when the beam is in a second position. When the beam is in its second position the electrical circuit is closed by contacts fed by the beam coming into contact with fixed contacts placed on a substrate. At rest, the beam is in its first position, and the electrical circuit is therefore open. This rest position is maintained thanks to the magnetic field produced on the magnetizable beam by a permanent magnet. When the electromagnet is energized, it produces a second magnetic field oriented so as to cause the beam to switch from its first position to its second position. Once the beam is in its second position, the electromagnet is deactivated and the beam is maintained in this second position under the effect of the permanent magnetic field.

In U.S. Pat. No. 6,750,745 several identical microactuators may be placed on one and the same substrate and may thus be actuated simultaneously by the electromagnet. In that patent, the coil is a flat coil and is integrated into the substrate. The microactuators are placed on the various faces of the flat coil. Although such a device does make it possible for several microactuators to be actuated simultaneously from a single coil, it does have a number of drawbacks. These drawbacks are the following:

- the use of a planar coil integrated into the substrate increases the average substrate area needed per microactuator, thereby incurring an additional cost for each microactuator;
- the integration of the coil into the substrate adds steps to the planar fabrication process, thereby reducing the production efficiency and incurring an additional cost for each microactuator; and
- the electrical resistance of the coil integrated into the substrate converts, by the Joule effect, some of the energy for activating the microactuators into heat, which is dissipated in the substrate and in the electrodes. The consequence of this heat generation is to degrade the electrical performance of the microactuators used as switches, contactors or relays.

The object of the invention is therefore to propose a microsystem which allows the aforementioned drawbacks to be alleviated, which is of simple design and of moderate cost, and which may comprise, if necessary, a large number of microactuators.

This object is achieved by a microsystem comprising:

- a magnetic microactuator comprising a moving element, supported by a substrate and controlled by a magnetic effect, capable of moving between a first position and a second position in order to switch at least one electrical circuit;
- a permanent magnet or an electromagnet subjecting the moving element to a first magnetic field in order to keep it in the first position; and
- an excitation coil external to the substrate, said excitation coil being capable, when it is powered, of subjecting the moving element to a second magnetic field in order to make the moving element pass from the first position to the second position, characterized in that:
- the excitation coil is of solenoid type and in that it surrounds the substrate supporting the moving element.

According to the invention, the microactuator is therefore placed at the center of the solenoid coil. Contrary to the teaching of the abovementioned patents, according to the invention the coil is external to the substrate, that is to say not integrated into it. This allows some of the drawbacks listed above to be alleviated. The fabrication of an external coil by printed-circuit techniques, by coiling a copper wire, or any other three-dimensional packaging solution, does not have the drawbacks of an integrated coil, and the production efficiency for both these techniques is very well controlled.

According to one feature, the moving element comprises a membrane mounted on the substrate, having a longitudinal axis and capable of pivoting between its various positions along an axis perpendicular to the longitudinal axis, said membrane having at least one layer made of a magnetic material.

In the prior art, the magnetic field is generated by means of a permanent magnet, for example bonded to the substrate. During assembly of the microsystems of the prior art, one step consists in correctly positioning the permanent magnet with respect to the microactuator so that the magnetic field generated by the magnet has the desired influence on the moving element of the microactuator. According to the invention, the use of a gap in which the first generated magnetic field is uniform dispenses with this step during assembly.

As is known, the first magnetic field created in the gap is uniform and is oriented perpendicular to the surface of the substrate supporting the microactuator. This first magnetic field generates a magnetic component in the membrane along its axis. The magnetic moment resulting from this field and from the magnetic component in the membrane forces the latter to remain in one position. The second magnetic field created by the excitation coil is perpendicular to the direction of the first magnetic field. This second field generates a magnetic component in the membrane on its axis which opposes the first component generated by the magnetic field. If this new magnetic component has a larger amplitude, the membrane pivots into its other position.

According to another feature, the excitation coil of solenoid type has a variable density of turns along its length.

According to another feature, the excitation coil has a larger number of turns at each of its ends. This makes the second axial magnetic field generated in the solenoid uniform, and therefore increases the useful volume of the solenoid.

According to another feature, the magnetic source of the magnetic circuit for generating the first magnetic field is a permanent magnet or an electromagnetic coil.

According to another feature, the substrate is subjected to a uniform magnetic field, the field lines of which follow a direction that is not perpendicular to the plane defined by the surface of the substrate supporting the magnetic microactuator. Such a configuration makes it possible to increase the magnetic moment on the membrane, and therefore to increase the contact force of the microactuator. Furthermore, another advantage associated with this inclination is manifested during the process for fabricating the microsystem in a MEMs (MicroElectroMechanical System) technology, since, in this case, the inclination of the microactuator membrane is guaranteed by the disposition of the microsystem in the magnetic circuit generating the uniform field, and not by the thickness of the sacrificial layer. The sacrificial layer lying between the membrane and the substrate may therefore be thin.

According to the invention, the microsystem can control the opening and closing of two electrical circuits.

According to the invention, the microsystem may be fabricated at least partly in a MEMs-type technology.

According to a very advantageous embodiment, the substrate supports a plurality of identical magnetic microactuators capable of being actuated simultaneously by said excitation coil. Just one excitation coil of solenoid type surrounding the substrate therefore acts on a matrix of microactuators. The matrix is placed at the center of the solenoid coil. For example, the microactuators are microrelays connected via electrical tracks and arranged in series in order to increase the isolation voltage, or in parallel, to reduce the intensity of the current.

Other features and advantages will become apparent in the detailed description which follows, with reference to embodiments given by way of example and represented by the appended drawings in which.

The invention will now be described in conjunction with FIGS. 1 to 7.

As in the abovementioned prior art, a microsystem according to the invention controls the opening or closing of an electrical circuit using a magnetic microactuator 2, 2'.

Figure 2A:
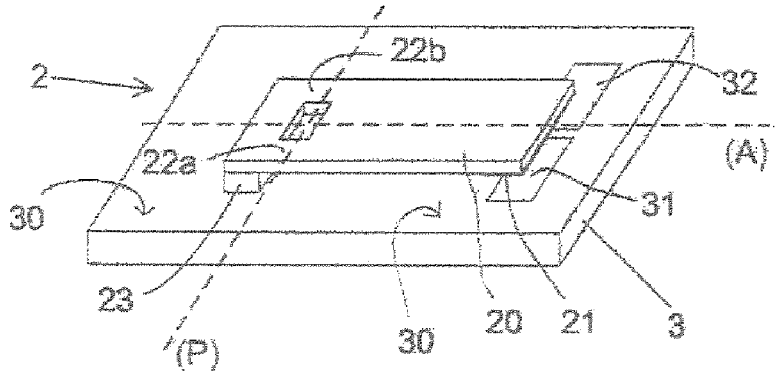
FIGS. 2A and 2B show, in perspectives a microactuator according to two embodiment variants that can be used in a microsystem according to the invention.
Figure 2B:
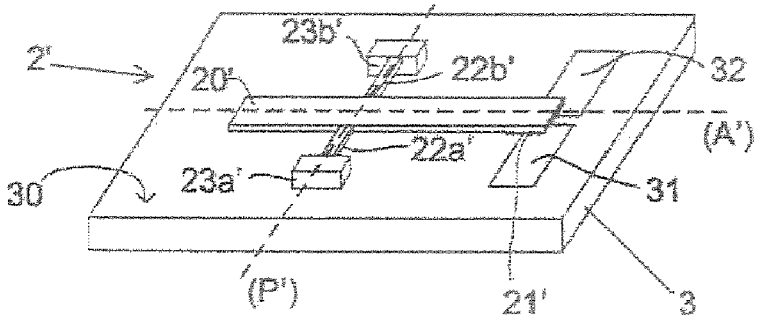

Referring to FIGS. 2A and 2B, a microsystem comprises a microactuator 2, 2' supported by a substrate 3. The substrate 3 is for example fabricated in materials such as glass, plastic or, for power applications, in materials that are good thermal conductors, based on silicon or ceramic. The substrate 3 has a flat surface 30 to which the microactuator 2, 2' is fixed. As is known (see Patent Application US 2002/0140533), the substrate 3 bears for example at least two electrodes 31, 32 (FIGS. 2A and 2B) intended to be electrically connected so as to close the electrical circuit. To do this, the magnetic microactuator 2, 2' bears at least one moving contact 21, 21' capable of electrically connecting the two electrodes 31, 32 when the microactuator 2, 2' is activated.

In a first embodiment variant shown in FIG. 2A, the microactuator 2 is composed of a moving element consisting of a membrane 20, for example a parallelepipedal membrane, having a longitudinal axis (A) and connected via one of its ends to an anchoring mount 23 fastened to the substrate 3 via two parallel linking arms 22*a*, 22*b*. The contact 21 is for example formed on the membrane 20 near the free end of the membrane 20 and faces the surface 30 of the substrate 3.

The membrane 20 is capable, by means of these two linking arms 22*a*, 22*b*, of pivoting relative to the substrate 3 about an axis (P) parallel to the axis described by the points of contact of the membrane 20 with the electrodes 31, 32, parallel to the surface (30) of the substrate and perpendicular to its longitudinal axis (A). The linking arms 22*a*, 22*b* form a resilient connection between the membrane 20 and the anchoring mount 23. In such a configuration, the membrane 20 is therefore made to pivot by the linking arms 22*a*, 22*b* flexing. As shown in FIG. 2A, in what is called an equilibrium position in which the arms 22*a*, 22*b* are not stressed, the membrane 20 is parallel to the plane formed by the surface 30 of the substrate 3.

In a second embodiment variant shown in FIG. 2B, a microactuator 2' that can be used in a microsystem according to the invention comprises a moving element consisting of a rigid membrane, for example a parallelepipedal membrane having a longitudinal axis (A'). Referring to FIG. 2B, this membrane 20' is fastened to the substrate 3 via two linking arms 22*a*', 22*b*' which connect said membrane 20' to two anchoring mounts 23*a*', 23*b*' placed symmetrically on either side of the membrane 20' and of its axis (A'). The moving contact 21' is for example formed on the membrane 20' near the end of the membrane 20 and faces the surface 30 of the substrate 3.

The membrane 20' is capable, by means of these two arms 22*a*', 22*b*', of pivoting relative to the substrate 3 about an axis (P') parallel to the axis described by the points of contact of the membrane 20' with the electrodes 31, 32, parallel to the surface (30) of the substrate and perpendicular to the longitudinal axis (A') of the membrane (20'). Preferably, in this embodiment variant, said pivot axis (P') of the membrane 20' is offset relative to the parallel mid-axis, thereby making it possible to define, on the membrane 20' on either side of its pivot axis (P'), two separate parts of different volumes. The free end of the larger part of the membrane 20' bears the contact 21' for closing an electrical circuit.

The linking arms 22*a*', 22*b*' form a resilient connection between the membrane 20' and their respective anchoring mount 23*a*', 23*b*'. In such a configuration, the membrane 20' is therefore made to pivot by the linking arms 22*a*', 22*b*' twisting. Other configurations may be perfectly suitable. As shown in FIG. 2B, in what is called an equilibrium position in which the arms are not stressed, the membrane 20' is parallel to the plane formed by the surface 30 of the substrate 3.

The two embodiment variants of the microactuator 2, 2' are perfectly usable in a microsystem according to the invention. The following description is applicable both to the microactuator according to the first embodiment variant and to that according to the second embodiment variant.

The microactuator 2, 2' described in the invention may be produced by a MEMS planar duplication technology. This is because production by the deposition of successive layers in an iterative process lends itself well to the fabrication of such objects. In this case, the membrane 20, 20' and the arms 22*a*, 22*b*, 22*a*', 22*b*' can be obtained from the same layer of material. However, in another configuration, the connecting arms

22*a*, 22*b*, 22*a*', 22*b*' and a lower layer of the membrane 20, 20' may be obtained from a metal layer. A layer of a material sensitive to magnetic fields is deposited on this metal layer in order to generate the upper part of the membrane 20, 20'. Such a configuration allows the mechanical properties of the linking arms 22*a*, 22*b*, 22*a*', 22*b*' to be optimized by using, to make the membrane 20, 20' pivot, a material that is mechanically more suitable than the material sensitive to the magnetic fields. In addition, the metal layer may act as contact for closing an electrical circuit. The material sensitive to the magnetic fields is for example of the soft magnetic type and may for example be an iron-nickel alloy (Permalloy, $Ni_{80}Fe_{20}$).

The principle of the invention will now be described below in connection with the first embodiment of the microactuator shown in FIG. 2A, but it should be understood that this can be applied to the microactuator according to the second embodiment shown in FIG. 2B.

Figure 3A:
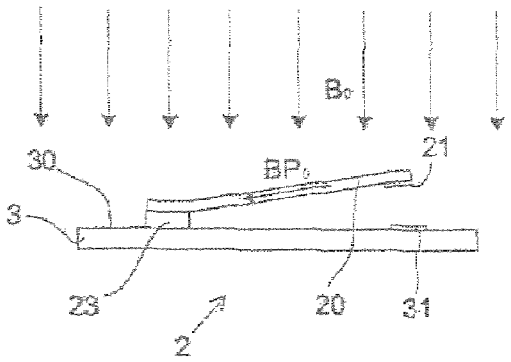
FIGS. 3A to 3C show, in side view, the various implementation steps for making the moving element of a microactuator pivot.
Figure 3B:
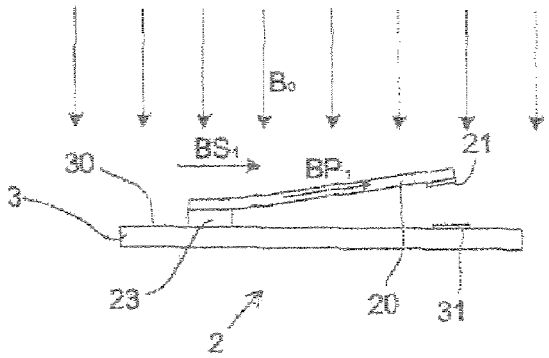
Figure 3C:
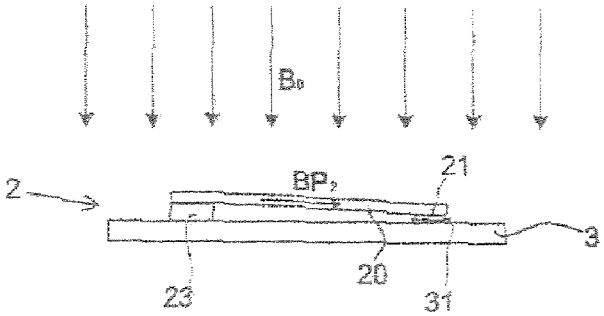

Referring to FIGS. 1 and 3A to 3C, it is therefore possible to make the membrane 20 pivot about its pivot axis (P) by subjecting the membrane 20 to a magnetic field produced by an external excitation coil of solenoid or planar type. The membrane 20 is therefore capable of adopting two separate extreme positions. Referring to FIGS. 3A to 3C, in which only the first embodiment of the actuator is shown, in a first extreme position (FIGS. 3A and 3B) the end of the membrane 20 bearing the contact 21 is raised and is not pressed against the electrodes 31, 32. The electrical circuit is therefore opened. In its second extreme position (FIG. 3C) the end of the membrane 20 bearing the contact 21 is pressed against the electrodes 31, 32. In this second position the electrical circuit is closed.

Figure 4A:
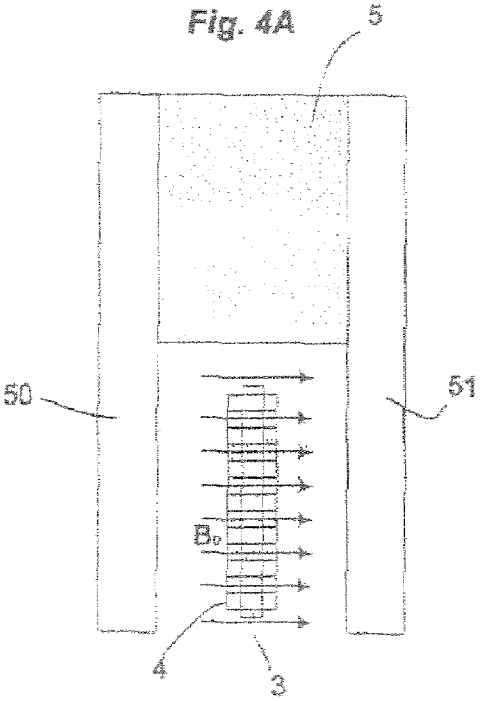
FIGS. 4A and 4B show a microsystem according to the invention, placed between two gap pieces of a magnetic circuit.
Figure 4B:
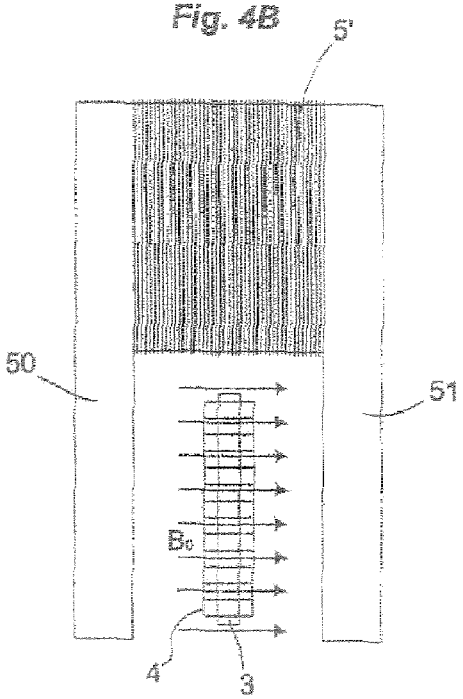

According to the invention, a first magnetic field $B_0$, which is preferably as uniform as possible, is applied to the substrate 3 bearing the microactuator 2. This first magnetic field $B_0$ has field lines perpendicular to the surface 30 of the substrate. As shown in FIGS. 3A to 3C, the field lines of this first magnetic field $B_0$ are directed towards the surface 30 of the substrate 3. This first magnetic field $B_0$ may be generated by a permanent magnet or by an electromagnet. A magnetic circuit having as magnetic source a permanent magnet 5 or an electromagnetic coil 5' may be used to create this first magnetic field $B_0$. As shown in FIGS. 4A and 4B, this magnetic circuit is made up of a permanent magnet 5 (FIG. 4A) or an electromagnetic coil 5' (FIG. 4B) and of two gap pieces 50, 51 placed parallel to and on either side of the permanent magnet 5 or the coil 5', and between which gap pieces the first magnetic field $B_0$ is generated. Such a magnetic circuit may be used to generate a first uniform magnetic field $B_0$ in the gap.

Figure 1:
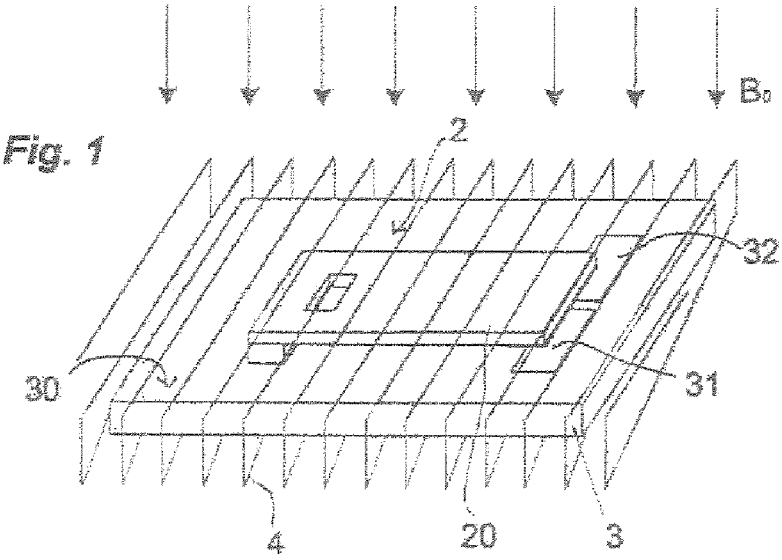
FIG. 1 shows, in perspective, a microsystem according to one particular embodiment of the invention.

An external excitation coil 4 of solenoid type as shown in FIG. 1, connected to a current source, surrounds the substrate 3 and the microactuator 2 supported by the substrate 3 in order to control the movement of the membrane 20 between its two positions. The microactuator 2 is therefore placed at the center of the excitation coil 4, in its central channel. The flow of a current in the excitation coil 4 causes the membrane 20 to pivot from one of its positions to the other of its positions. The direction of the current flowing through the excitation coil 4 decides whether the membrane 20 pivots towards one of its extreme positions or towards the other. For the sake of simplicity and ease of examination, the excitation coil 4 is not shown in FIGS. 3A to 3C. It must, however, be borne in mind that the excitation coil 4 surrounds the microactuator in these figures, as is shown in FIG. 1.

The substrate 3 supporting the microactuator 2 and surrounded by the solenoid excitation coil is placed under the effect of the first magnetic field $B_0$, for example in the gap of the magnetic circuit described above in conjunction with FIGS. 4A and 4B. As shown in FIG. 3A the first magnetic field $B_0$ initially generates a magnetic component $BP_0$ in the membrane 20 along its longitudinal axis (A). The magnetic moment resulting from the magnetic field $B_0$ and from the component $BP_0$ generated in the membrane 20 keeps the membrane 20 in one of its extreme positions, for example in the first position (FIG. 3A) or in the second position (FIG. 3C). In the first position, the contacting part of the membrane 20 is therefore raised, and the electrical circuit is open. In the second position the contact 21 borne by the membrane 20 electrically connects the two electrodes 31, 32, and the circuit is closed.

With the membrane 20 considered to be initially in its first position (FIG. 3A), the switching into the second position takes place in the following manner:

Referring to FIG. 3B, the flow of a current in a defined direction in the solenoid excitation coil 4 surrounding the substrate 3 generates a second magnetic field $BS_1$, the direction of which is parallel to the substrate 3 and perpendicular to the pivot axis (P) of the membrane 20, its direction depending on the direction of the current delivered into the excitation coil 4. The second magnetic field $BS_1$ created by the excitation coil 4 generates a magnetic component $BP_1$ in the magnetic layer of the membrane 20, along its longitudinal axis (A). If the current is delivered in a suitable direction, this new magnetic component $BP_1$ opposes the component $BP_0$ generated in the magnetic layer of the membrane 20 by the magnetic field $B_0$. If the component $BP_1$ generated by the excitation coil 4 is of higher intensity than that generated by the magnetic field $B_0$, the magnetic moment resulting from the magnetic field $B_0$ and from this component $BP_1$ is reversed, and causes the membrane 20 to pivot from its first position into its second position.

Once the membrane 20 has pivoted, it is no longer necessary to power the excitation coil 4 According to the invention the second magnetic field $BS_1$ created by the excitation coil 4 is only a transient field and is useful only for making the membrane 20 pivot from one position to the other. As shown in FIG. 3C, the membrane 20 is then kept in its second position under the effect of just the first magnetic field $B_0$, creating a new magnetic component $BP_2$ in the membrane 20. The new magnetic moment created between the first magnetic field $B_0$ and the component $BP_2$ generated in the membrane 20 forces the membrane 20 to remain in its second position.

Once the membrane 20 has pivoted into its second position, the contact 21 borne by the membrane 20 electrically connects the two electrodes 31, 32 present on the substrate 3. The electrical circuit is therefore closed.

To open the electrical circuit, the membrane 20 must again be pivoted into its first position. A current is delivered into the excitation coil 4 in the opposite direction to that defined above. The magnetic field created by the excitation coil 4 is therefore oriented in the opposite direction to the previous magnetic field $BS_1$. This magnetic field generates, along the longitudinal axis (A), a magnetic component in the membrane 20 opposing the component $BP_2$. If this new magnetic component is of higher intensity than the component $BP_2$, the magnetic moment resulting from the first magnetic field $B_0$ and from this new magnetic component causes the membrane 20 to switch into its first position.

The intensity of the current to be delivered into the excitation coil 4 in order to make the membrane 20 pivot depends on the number of turns constituting the excitation coil 4 and on the density of the magnetic field along the excitation coil 4.

Figure 6:
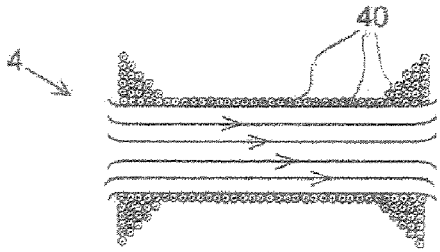
FIG. 6 shows in a simplified manner, an example of the winding of the turns that can be used for the solenoid coil of a microsystem according to the invention.

According to the invention, referring to FIG. 6, the solenoid excitation coil 4 has a density of turns 40 that vary along its length. The number of turns 40 is larger at the ends than at the centre of the excitation coil 4. The magnetic field generated in the solenoid is thus perfectly uniform over the entire length of the excitation coil 4. The high degree of uniformity of the magnetic field ($BS_1$ for example in FIG. 3B) generated by the excitation coil 4 makes it possible to increase the useful volume within the solenoid.

According to the invention, the excitation coil 4 of solenoid type may be fabricated by printed-circuit technique or by a copper-wire winding technique.

Figure 5A:
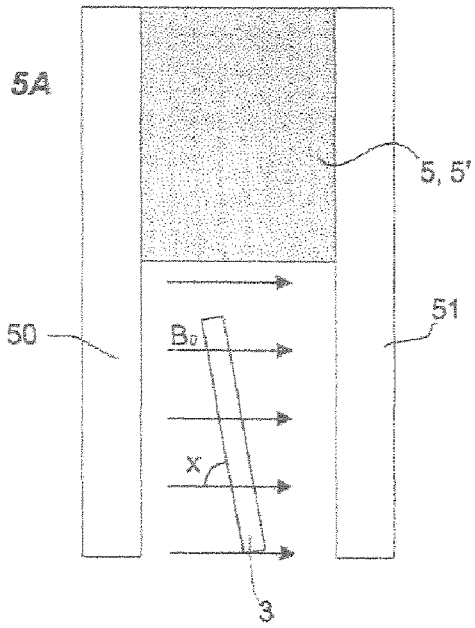
FIGS. 5A and 5B show two embodiments for improving the contact force of the microactuator.
Figure 5B:
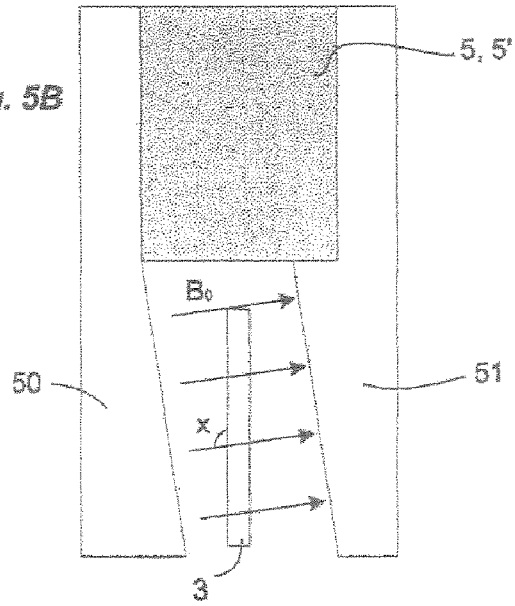

According to the invention, to improve the contact force between the membrane 20 and the substrate 3, the magnetic moment existing between the first magnetic field $B_0$ and the component generated in the membrane 20 is increased. To do this, the angle x between the direction of the first magnetic field $B_0$ and the surface 30 of the substrate 3 is varied (see FIGS. 5A and 5B). This angle x must be different from 90°. The angle x made between the direction of the field lines and the surface 30 of the substrate supporting the microactuator may be fixed either by having the substrate 3 inclined to the direction of the permanent field (FIG. 5A) or by giving the two gap pieces 50, 51 a particular shape to generate a magnetic field in the gap, the direction of which would be inclined at the angle x to the surface 30 of the substrate 3 (FIG. 5B). Referring to FIG. 5B, each gap piece may be beveled or, in another embodiment (not shown), each of these pieces 50, 51 may be bent.

Figure 7:
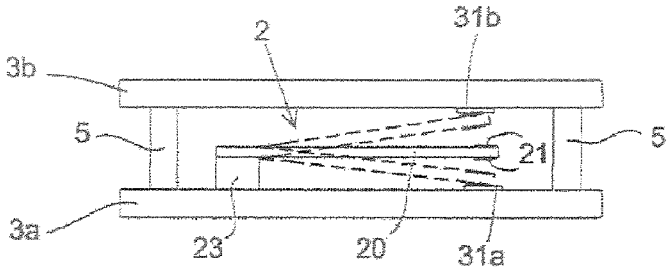
FIG. 7 shows the operation of a microsystem according to the invention for actuating two electrical circuits.

According to an embodiment variant shown in FIG. 7, a microsystem according to the invention is used for controlling two separate electrical circuits. According to this embodiment, a first substrate 3*a* bears the electrodes 31*a* of a first electrical circuit and a second substrate 3*b*, for example placed above and parallel to the first substrate 3*a*, bears the electrodes 31*b* of a second electrical circuit The electrodes 31*a*, 31*b* are placed symmetrically with respect to the longitudinal axis (A) of the membrane 20 of a microactuator 2 according to the invention when the membrane is a rest. The two substrates are for example connected via connecting elements 5. The microactuator 2 according to the invention is fastened to at least one of the substrates 3*a*, 3*b*. The pivoting membrane 20 can therefore pivot between its two extreme positions in order to close, in each of its extreme positions, one or other of the electrical circuits. In an equilibrium position (shown by the solid line in FIG. 7), the two electrical circuits are open and the membrane 20 is parallel to the two substrates 3*a*, 3*b*. In a first extreme position (shown by dotted lines in FIG. 7) the membrane 20 comes into contact with the first electrode 31*a* in order to close the first electrical circuit, whereas in its second, opposite, extreme position (shown by dotted lines in FIG. 7), the membrane 20 comes into contact with the second electrode 31*b* in order to close the second electrical circuit.

According to the invention, a microsystem according to the invention may comprise a plurality of identical microactuators 2, 2' as described above, forming a matrix placed at the center of the solenoid excitation coil 4. With the same actuation energy coming from the activation of the solenoid excitation coil 4, it is possible for a large number of magnetic microactuators 2, 2', arranged in series or in parallel, to be actuated simultaneously. The microactuators 2, 2' are for example organized along several parallel rows. Thus, by powering the excitation coil 4, 6, all the microactuators 2, 2' of a row or of several rows may be actuated simultaneously.

Of course, it is possible, without departing from the scope of the invention, to conceive of other embodiments and detailed improvements and likewise to envisage the use of equivalent means.

The invention claimed is:

1. A microsystem comprising:

a magnetic microactuator including a moving element, supported by a substrate and controlled by a magnetic effect, configured to move between a first position and a second position to switch at least one electrical circuit;

a magnetic source subjecting the moving element to a first magnetic field to keep the moving element in the first position; and an excitation coil external to the substrate, the excitation coil being configured, when powered, to subject the moving element to a second magnetic field to make the moving element pass from the first position to the second position, wherein the excitation coil is of solenoid type and surrounds the substrate supporting the moving element.

2. The microsystem as claimed in claim 1, wherein the moving element includes a membrane mounted on the substrate, having a longitudinal axis and configured to pivot between various positions along an axis perpendicular to the longitudinal axis, the membrane including at least one layer made of a magnetic material.

3. The microsystem as claimed in claim 1, wherein the first magnetic field is uniform and oriented perpendicular to a plane surface of the substrate on which the moving element is mounted.

4. The microsystem as claimed in claim 1, further comprising:

two planar gap elements placed parallel to each other and having a separation formed between them, wherein the magnetic source is provided between opposing surfaces of the gap elements and in contact with the opposing surfaces, and wherein the substrate supporting the microactuator is placed within a gap formed between the two gap elements adjacent to the magnetic source.

5. The microsystem as claimed in claim 4, wherein the magnetic source is a permanent magnet.

6. The microsystem as claimed in claim 4, wherein the magnetic source is an electromagnetic coil.

7. The microsystem as claimed in claim 1, wherein the excitation coil has a variable density of turns along its length.

8. The microsystem as claimed in claim 7, wherein the excitation coil has a larger number of turns at each of its ends.

9. The microsystem as claimed in claim 1, wherein the first magnetic field has field lines following a direction that is not perpendicular to the plane defined by a surface of the substrate supporting the magnetic microactuator.

10. The microsystem as claimed in claim 1, controlling opening and closing of two electrical circuits.

11. The microsystem as claimed in claim 1, fabricated in a MEMs-type technology.

12. The microsystem as claimed in claim 1, wherein the substrate supports a plurality of identical magnetic microactuators configured to be actuated simultaneously by the excitation coil.

* * * * *